US006752065B2

(12) United States Patent
Sugioka et al.

(10) Patent No.: US 6,752,065 B2
(45) Date of Patent: Jun. 22, 2004

(54) SLIDING MEMBER AND SLIDING DEVICE

(75) Inventors: Takahiro Sugioka, Kariya (JP); Akira Onoda, Kariya (JP); Minoru Mera, Kariya (JP); Tomohiro Murakami, Kariya (JP); Manabu Sugiura, Kariya (JP)

(73) Assignee: Kabushiki Kaisha Toyota Jidoshokki, Kariya (JP)

( * ) Notice: Subject to any disclaimer, the term of this patent is extended or adjusted under 35 U.S.C. 154(b) by 0 days.

(21) Appl. No.: 10/262,011

(22) Filed: Sep. 30, 2002

(65) Prior Publication Data

US 2003/0089223 A1 May 15, 2003

(30) Foreign Application Priority Data

Nov. 7, 2001 (JP) ..... 2001-341574

(51) Int. Cl.[7] ..... F04B 21/00
(52) U.S. Cl. ..... 92/12.2; 92/71
(58) Field of Search ..... 92/12.2, 71, 155; 91/499

(56) References Cited

U.S. PATENT DOCUMENTS 6,123,009 A 9/2000 Kanayama et al. ..... 92/71
6,289,785 B1 9/2001 Ikeda et al. ..... 92/71
6,305,847 B1 * 10/2001 Tanaka et al. ..... 384/297
6,357,340 B1 * 3/2002 Kato et al. ..... 92/155
2002/0046646 A1 4/2002 Sugiura et al. ..... 92/71
2002/0046647 A1 4/2002 Sugiura et al. ..... 92/71
2003/0031389 A1 * 2/2003 Kanayama et al. ..... 384/42

FOREIGN PATENT DOCUMENTS

JP A-60-22080 2/1985
JP A-7-247493 9/1995
JP A-8-199327 8/1996
JP A-9-209926 8/1997

* cited by examiner

*Primary Examiner*—Thomas E. Lazo
(74) *Attorney, Agent, or Firm*—Woodcock Washburn LLP

(57) ABSTRACT

A sliding member comprising at least one sliding layer including a solid lubricant and at least one thermosetting resin with which particles of the solid lubricant are held together, the solid lubricant containing 10–40 vol. % of polytetrafluoroethylene. A sliding device comprising: at least one first sliding member each including at least one sliding layer which includes a solid lubricant and at least one thermosetting resin with which particles of the solid lubricant are held together, the solid lubricant containing 10–40 vol. % of polytetrafluoroethylene; and at least one second sliding member plated with a nickel-based composition; and wherein the at least one first sliding member and the at least one second sliding member slide relative to each other.

11 Claims, 3 Drawing Sheets

SLIDING MEMBER AND SLIDING DEVICE

This application is based on Japanese Patent Application No. 2001-341574 filed Nov. 7, 2001, the contents of which are incorporated hereinto by reference.

BACKGROUND OF THE INVENTION

1. Field of the Invention

The present invention relates in general to a sliding device which is disposed between a plurality of members for permitting a smooth movement of the members relative to each other, and a sliding member used for the sliding device.

2. Discussion of the Related Art

As one example of the sliding member, JP-A-60-22080 discloses a swash plate and a shoe of a swash plate type compressor, at least one of which has a solid-lubricant layer including a solid lubricant and a thermosetting resin with which particles of the solid lubricant are held together. Examples of the solid lubricant include molybdenum disulfide, tungsten disulfide, graphite, boron nitride, and fluororesin, while examples of the thermosetting resin include phenol resin, epoxy resin, furan resin, urea resin, polyamideimide resin, and unsaturated polyester. JP-A-8-199327 discloses a swash plate formed of a ferrous material or an aluminum material. The swash plate is covered with a hard layer and a soft layer formed on its surface in this order. The hard layer is formed by spraying of a copper-based or an aluminum-based material, while the soft layer is formed by plating of lead, tin, or lead-tin, or coating of polytetrafluoroethylene, molybdenum disulfide, or molybdenum disulfide-graphite.

SUMMARY OF THE INVENTION

Each of the sliding members disclosed in the above-indicated publications has good characteristics. The sliding member, however, is required to be operated under a severer or heavier load conditions, as various devices in which the sliding member is installed are required to have reduced size and weight, and increased performance. Accordingly, there is a demand for developing the sliding member having improved characteristics. As a result of an extensive study made by the inventors of the present invention to meet the demand, it was found that the sliding member having a sliding layer which contains a relatively large amount of polytetrafluoroethylene exhibits excellent resistances to seizure and wear under the heavy load condition in which the swash plate type compressor is operated in a non-lubricating state (dry state), for instance. It is therefore an object of the present invention to provide a sliding device and a sliding member, which exhibit excellent resistances to seizure and wear under the heavy load condition. The object may be achieved according to any one of the following modes of the present invention, each of which is numbered like the appended claims and depends from the other mode or modes, where appropriate, to indicate and clarify possible combinations of elements or technical features of the present invention, for easier understanding of the invention. It is to be understood that the present invention is not limited to the technical features or any combinations thereof which will be described for illustrative purpose only. It is to be further understood that a plurality of elements or features included in any one of the following modes of the invention are not necessarily provided all together, and that the invention may be embodied without some of the elements or features described with respect to the same mode.

(1) A sliding member comprising at least one sliding layer including a solid lubricant and at least one thermosetting resin with which particles of the solid lubricant are held together, the solid lubricant containing 10–40 vol. % of polytetrafluoroethylene.

The sliding member having the sliding layer which contains a relatively large amount of polytetrafluoroethylene exhibits excellent resistances to seizure and wear under a very severe sliding condition or a heavy load condition in which the lubricant is not present or extremely insufficient. Accordingly, the sliding member constructed as described above is suitably used for a sliding device which is operated under the severe sliding condition or heavy load condition. For instance, the present sliding member is used for a sliding device of a compressor, a general-purpose slide bearing, and a sliding portion between a piston and a cylinder block in an engine.

(2) A sliding member according to the above mode (1), wherein the solid lubricant contains not less than 14 vol. % of said polytetrafluoroethylene.

(3) A sliding member according to the above mode (2), wherein the solid lubricant contains not less than 18 vol. % of the polytetrafluoroethylene.

(4) A sliding member according to any one of the above modes (1)–(3), wherein the solid lubricant further contains 5–30 vol. % of molybdenum disulfide.

If the solid lubricant further contains molybdenum disulfide, the sliding member advantageously exhibits further improved sliding characteristics. The molybdenum disulfide is contained in the solid lubricant preferably in an amount of not smaller than 7 vol. %, more preferably in an amount of not smaller than 15 vol. %.

(5) A sliding member according to any one of the above modes (1)–(4), wherein the at least one thermosetting resin contains polyamide imide as a major component.

As the thermosetting resin, it is preferable to employ phenol resin, epoxy resin, furan resin, urea resin, and unsaturated polyester, for example particularly preferably used is polyamide imide resin.

(6) A sliding device comprising:

at least one first sliding member each including at least one sliding layer which includes a solid lubricant and at least one thermosetting resin with which particles of the solid lubricant are held together, the solid lubricant containing 10–40 vol. % of polytetrafluoroethylene; and at least one second sliding member plated with a nickel-based composition; and wherein the at least one first sliding member and the at least one second sliding member slide relative to each other.

Where the present sliding member having the sliding layer which contains a relatively large amount of polytetrafluoroethylene slides on a member which is covered with a nickel-based plating, the present sliding member exhibits significantly higher degrees of seizure resistance and wear resistance than the other kind of sliding member which contains a relatively large amount of molybdenum disulfide in place of the polytetrafluoroethylene. Any one of the features according to the above-described modes (2)–(5) is applicable to the sliding device according to this mode (6).

(7) A sliding device according to the above mode (6), wherein the at least one second sliding member includes a base body formed of an aluminum alloy and plated with the nickel-based composition.

(8) A sliding device according to the above mode (6) or (7), wherein the at least one second sliding member is plated by electroless plating of the nickel-based composition.

(9) A sliding device according to any one of the above modes (6)–(8), wherein the at least one second sliding member is plated with at least one nickel-based plating film which is formed of the nickel-based composition and which is selected from a Ni—P film, a Ni—B film, a Ni—P—B—W film, and a Ni—P—B film.

(10) A sliding device according to any one of the above modes (6)–(9), wherein the sliding device is used for a compressor.

In the compressor such as a refrigerant gas compressor for an automotive vehicle, the lubricant is mixed in the form of a mist in the pressurized refrigerant gas, so that the sliding member is lubricated by a mist of lubricant contained in the pressurized refrigerant gas. When this type of compressor is re-started after a relatively long period of interruption, the sliding device of the compressor is operated substantially in the absence of the lubricant. In this case, the sliding member tends to suffer from seizure. The sliding member exhibits a higher degree of resistance to seizure with an increase in the amount of the solid lubricant contained in its sliding layer. The increase of the amount of the solid lubricant, however, undesirably lowers the wear resistance of the sliding member. The present sliding member whose sliding layer contains a relatively large amount of polytetrafluoroethylene exhibits high degrees of seizure resistance and wear resistance. The present invention is preferably applicable to sliding devices of various kinds of compressors, e.g., vanes and a rotor or vanes and side plates of a vane compressor, two scrolls of a scroll compressor, shoes and a swash plate of a swash plate type compressor, etc.

(11) A sliding device according to the above mode (10), wherein the compressor is of swash plate type, the sliding device comprising a swash plate as the at least one first sliding member and shoes each as the at least one second sliding member for sliding on the swash plate.

In general, the swash plate is formed of a ferrous material, especially cast iron.

(12) A sliding device according to any one of the above modes (6)–(11), wherein the at least one first sliding member includes a ferrous base body and the at least one sliding layer formed on the ferrous base body.

BRIEF DESCRIPTION OF THE DRAWINGS

The above and optional objects, features, advantages and technical and industrial significance of the present invention will be better understood and appreciated by reading the following detailed description of a presently preferred embodiment of the invention, when considered in connection with the accompanying drawings, in which.

DETAILED DESCRIPTION OF THE PREFERRED EMBODIMENT

Figure 1:
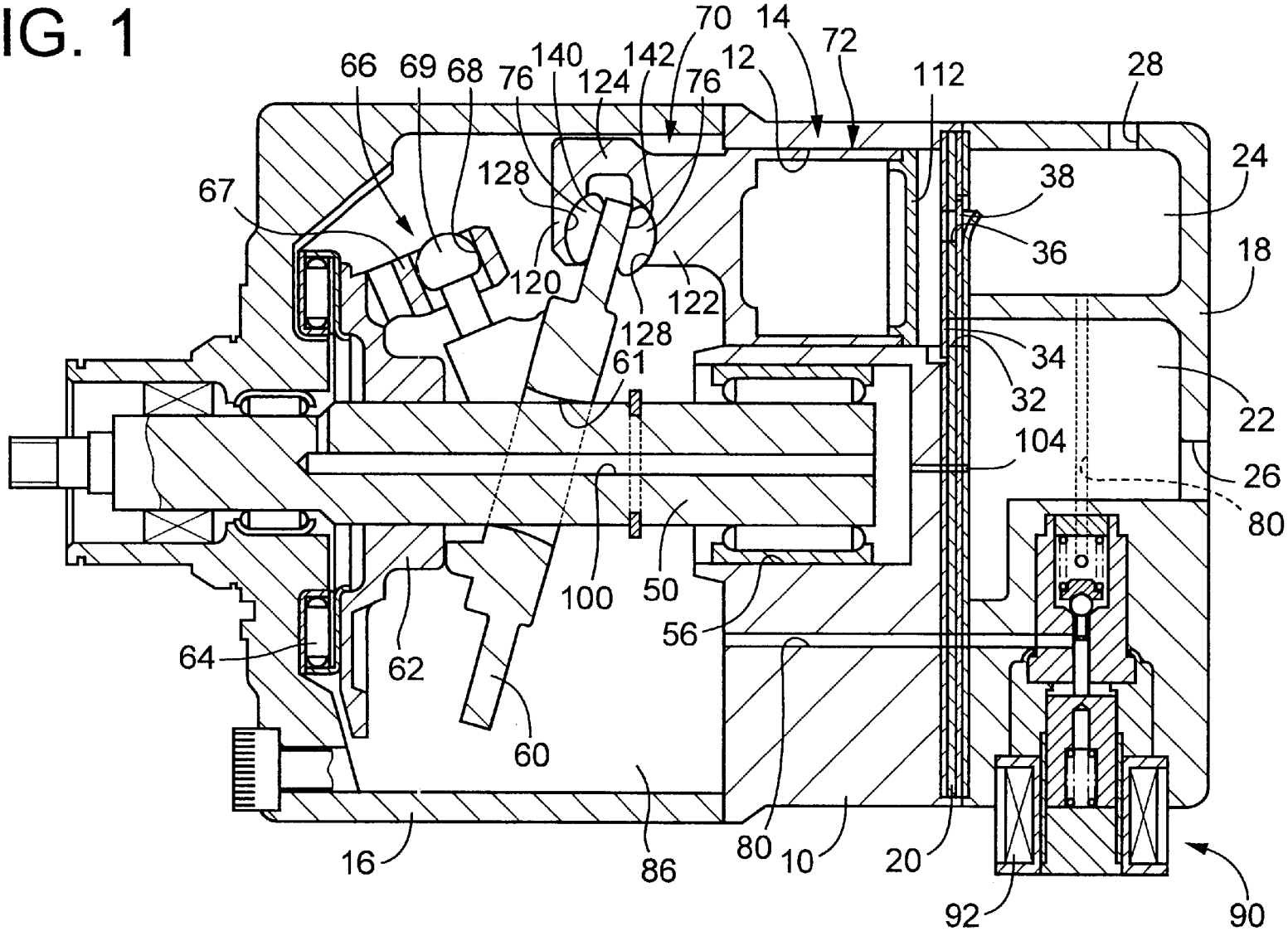
FIG. 1 is a front elevational view in cross section of a swash plate type compressor which is equipped with a swash plate and shoes constituting a sliding device according to one embodiment of the present invention.

Referring to the accompanying drawings, there will be described a presently preferred embodiment of this invention as applied to a swash plate type compressor used for an air conditioning system of an automotive vehicle and adapted to compress the refrigerant. Referring first to FIG. 1, there is shown a compressor of swash plate type. In FIG. 1, reference numeral 10 denotes a cylinder block having a plurality of cylinder bores 12 formed so as to extend in its axial direction such that the cylinder bores 12 are arranged along a circle whose center lies on a centerline of the cylinder block 10. Single-headed pistons generally indicated at 14 (hereinafter simply referred to as "piston 14") are reciprocably received in the respective cylinder bores 12. To one of the axially opposite end faces of the cylinder block 10, (the left end face as seen in FIG. 1, which will be referred to as "front end face"), there is attached a front housing 16. To the other end face (the right end face as seen in FIG. 1, which will be referred to as "rear end face"), there is attached a rear housing 18 through a valve plate 20. The front housing 16, rear housing 18 and cylinder block 10 cooperate to constitute a housing assembly of the swash plate type compressor. The rear housing 18 and the valve plate 20 cooperate to define a suction chamber 22 and a discharge chamber 24, which are connected to a refrigerating circuit (not shown) through an inlet 26 and an outlet 28, respectively. The valve plate 20 has suction ports 32, suction valves 34, discharge ports 36 and discharge valves 38.

A rotary drive shaft 50 is disposed in the cylinder block 10 and the front housing 16 such that the axis of rotation of the drive shaft 50 is aligned with the centerline of the cylinder block 10. The drive shaft 50 is supported at its opposite end portions by the front housing 16 and the cylinder block 10, respectively, via respective bearings, such that the drive shaft 50 is rotatable relative to the front housing 16 and the cylinder block 10. The cylinder block 10 has a central bearing hole 56 formed in a central portion thereof, and the bearing is disposed in this central bearing hole 56, for supporting the drive shaft 50 at its rear end portion. The front end portion of the drive shaft 50 is connected, through a clutch mechanism such as an electromagnetic clutch, to an external drive source (not shown) in the form of an engine of an automotive vehicle. In operation of the compressor, the drive shaft 50 is connected through the clutch mechanism to the vehicle engine in operation so that the drive shaft 50 is rotated about its axis.

The rotary drive shaft 50 carries a swash plate 60 such that the swash plate 60 is axially movable and tiltable relative to the drive shaft 50. The swash plate 60 has a central hole 61 through which the drive shaft 50 extends. The inner dimension of the central hole 61 as measured in a vertical direction of FIG. 1 gradually increases in a direction from the axially intermediate portion toward each of the axially opposite ends, and the transverse cross sectional shape of the central hole 61 at each of the axially opposite ends is elongated. To the drive shaft 50, there is fixed a rotary member 62 as a torque transmitting member, which is held in engagement with the front housing 16 through a thrust bearing 64. The swash plate 60 is rotated with the drive shaft 50 by a hinge mechanism 66 during rotation of the drive shaft 50. The hinge mechanism 66 guides the swash plate 60 for its axial and tilting motions. The hinge mechanism 66 includes a pair of support arms 67 fixed to the rotary member 62, guide pins 69 which are formed on the swash plate 60 and which slidably engage guide holes 68 formed in the support arms 67, the central hole 61 of the swash plate 60, and the outer circumferential surface of the drive shaft 50.

The piston 14 indicated above includes an engaging portion 70 engaging the radially outer portion of the opposite surfaces of the swash plate 60, and a head portion 72 formed integrally with the engaging portion 70 and slidably fitted in the corresponding cylinder bore 12. The head portion 72 of the piston 14 in the present embodiment is made hollow, for thereby reducing the weight of the piston 14. The head portion 72, cylinder bore 12, and valve plate 20 cooperate with one another to define a pressurizing chamber. The engaging portion 70 engages the radially outer portion of the opposite surfaces of the swash plate 60 through a pair of part-spherical-crown shoes 76. The shoes 76 will be described in greater detail. The piston 14 in the present embodiment has a single head portion 72 at one of its opposite ends, and is referred to as the single-headed piston.

The piston 14 is reciprocated by rotation of the swash plate 60. Described in detail, a rotary motion of the swash plate 60 is converted into a reciprocating linear motion of the piston 14 through the shoes 76. A refrigerant gas in the suction chamber 22 is sucked into the pressurizing chamber of the cylinder bore 12 through the suction port 32 and the suction valve 34, when the piston 14 is moved from its upper dead point to its lower dead point, that is, when the piston 14 is in the suction stroke. The refrigerant gas in the pressurizing chamber of the cylinder bore 12 is pressurized by the piston 14 when the piston 14 is moved from its lower dead point to its upper dead point, that is, when the piston 14 is in the compression stroke. The pressurized refrigerant gas in the pressurizing chamber is discharged into the discharge chamber 24 through the discharge port 36 and the discharge valve 38. A reaction force acts on the piston 14 in the axial direction as a result of compression of the refrigerant gas in the pressurizing chamber. This compression reaction force is received by the front housing 16 through the piston 14, swash plate 60, rotary member 62 and thrust bearing 64.

The cylinder block 10 has an intake passage 80 formed therethrough for communication between the discharge chamber 24 and a crank chamber 86 which is defined between the front housing 16 and the cylinder block 10. The intake passage 80 is connected to a solenoid-operated control valve 90 provided to control the pressure in the crank chamber 86. The solenoid-operated control valve 90 includes a solenoid coil 92. The amount of electric current applied to the solenoid coil 92 is controlled depending upon the air conditioner load by a control device not shown constituted principally by a computer.

The rotary drive shaft 50 has a bleeding passage 100 formed therethrough. The bleeding passage 100 is open at one of its opposite ends to the central bearing hole 56, and is open at the other end to the crank chamber 86. The central bearing hole 56 communicates at its bottom with the suction chamber 22 through a communication port 104.

The present swash plate type compressor is of variable capacity type. By controlling the pressure in the crank chamber 86 by utilizing a difference between the pressure in the discharge chamber 24 as a high-pressure source and the pressure in the suction chamber 22 as a low pressure source, a difference between the pressure in the pressurizing chamber of the cylinder bore 12 and the pressure in the crank chamber 86 is regulated to change the angle of inclination of the swash plate 60 with respect to a plane perpendicular to the axis of rotation of the drive shaft 50, for thereby changing the reciprocating stroke (suction and compression strokes) of the piston 14, whereby the displacement capacity of the compressor can be adjusted. Described in detail, by energization and de-energization of the solenoid coil 92 of the solenoid-operated control valve 90, the crank chamber 86 is selectively connected to and disconnected from the discharge chamber 24, so that the pressure in the crank chamber 86 is controlled. The swash plate inclination angle changing device for changing the inclination angle of the swash plate in the present embodiment is constituted by the hinge mechanism 66, cylinder bores 12, pistons 14, suction chamber 22, discharge chamber 24, central bearing hole 56, crank chamber 86, bleeding passage 100, communication port 104, control device not shown, etc.

The cylinder block 10 and each piston 14 are formed of an aluminum alloy. The piston 14 is coated at its outer circumferential surface with a fluoro resin film which prevents a direct contact of the aluminum alloy of the piston 14 with the aluminum alloy of the cylinder block 10 so as to prevent seizure therebetween, and makes it possible to minimize the amount of clearance between the piston 14 and the cylinder bore 12. Other materials may be used for the cylinder block 10, the piston 14, and the coating film.

The end portion of the engaging portion 70 of the piston 14, which is remote from the head portion 72, has a U-shape in cross section. Described in detail, the engaging portion 70 has a base section 124 which defines the bottom of the U-shape, and a pair of substantially parallel arm sections 120, 122 which extend from the base section 124 in a direction perpendicular to the axis of the piston 14. The two opposed lateral walls of the U-shape of the engaging portion 70 have respective recesses 128 which are opposed to each other. Each of these recesses 128 is defined by a part-spherical inner surface of the lateral wall. The part-spherical inner surfaces of the recesses 128 are located on the same spherical surface.

Figure 2:
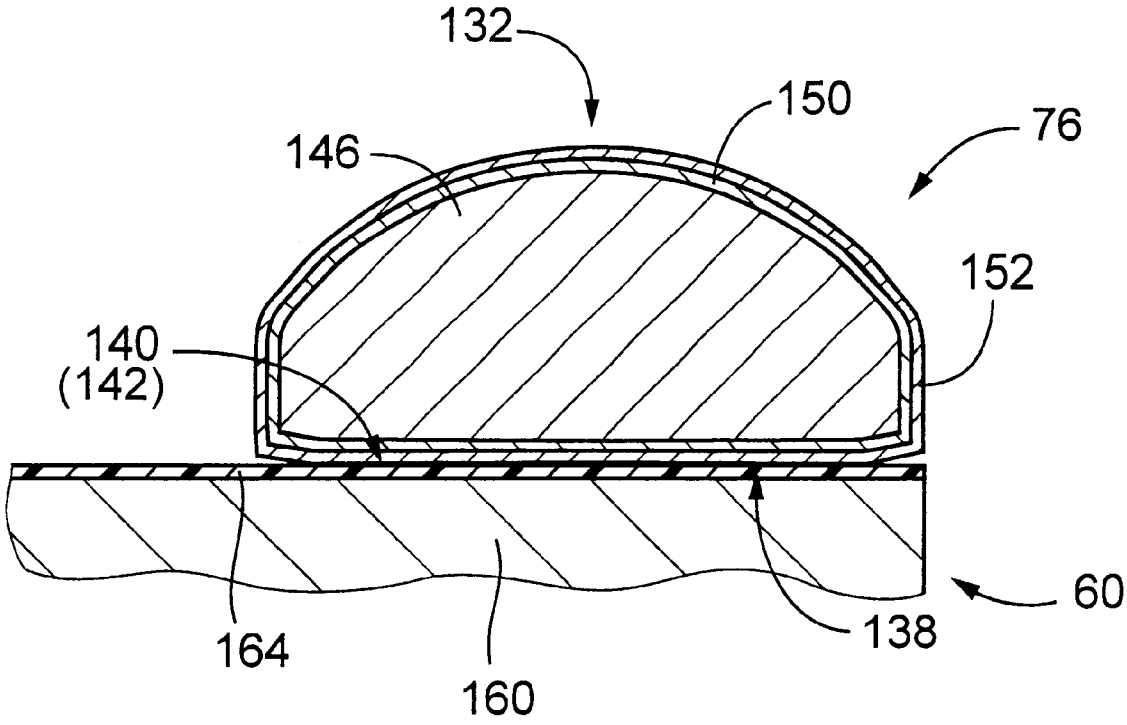
FIG. 2 is an enlarged front elevational view in cross section showing the shoe and a portion of the swash plate.

As shown in FIG. 2, each of the pair of shoes 76 has a substantially part-spherical crown shape, and includes a generally convex part-spherical surface 132 and a generally flat surface 138. Strictly speaking, the flat surface 138 is a slightly convex curved surface (e.g., a convex part-spherical surface having a considerably large radius of curvature), and includes a tapered portion formed at a radially outer portion thereof. The part-spherical surface 132 has a cylindrical portion formed adjacent to the flat surface 138. The boundary between the convex curved surface and the tapered portion, the boundary between the tapered portion and the cylindrical portion, and the boundary between the cylindrical portion and the part-spherical convex surface, are rounded so as to have respective different small radii of curvature. The pair of shoes 76 slidably engage the part-spherical inner surfaces of the recesses 128 of the piston 14 at their part-spherical surfaces 132 and slidably engage the radially outer portion of the opposite surfaces of the swash plate 60, i.e., sliding surfaces 140, 142 of the swash plate 60, at their flat surfaces 138. The pair of shoes 76 are designed such that their convex part-spherical surfaces 132 are located on the same spherical surface. In other words, each shoe 76 has a part-spherical crown shape whose size is smaller than a hemisphere by an amount corresponding to a half of the thickness of the swash plate 60. The shape of the shoe is not limited to that described above. For instance, the shoe used for a compressor of fixed capacity type desirably has a size slightly larger than the hemi-sphere for preventing a reduction in the sliding surface area even when the flat portion of the shoe is worn.

The shoe 76 includes a base body 146 and covering layers in the form of a first hard layer 150 and a second hard layer 152 which are formed on the outer surface of the base body 146 in this order. Described more specifically, the base body 146 of the shoe 76 is formed of an aluminum alloy (such as A4032 according to JIS H 4100) which contains aluminum as a major component, and silicon. The first hard layer 150 entirely covers the outer surface of the base body 146 of the shoe 76 while the second hard layer 152 entirely covers the outer surface of the first hard layer 150. In FIG. 2, the thickness of each of the first and second hard layers 150, 152 is exaggerated for easier understanding. The first hard layer 150 may be formed by electroless plating of a nickel-based composition. For instance, the first hard layer 150 is provided by a nickel-based plating film selected from a Ni—P film, a Ni—B film, a Ni—P—B—W film, and Ni—P—B film. In the present embodiment, the first hard layer 150 is provided by the Ni—P plating film. Similarly, the second hard layer 152 may be formed by electroless plating of a nickel-based composition. For instance, the second hard layer 152 is provided by a nickel-based plating film selected from a Ni—B film, a Ni—P—B—W film, and a Ni—P—B film. In the present embodiment, the second hard layer 152 is provided by the Ni—P—B—W plating film. Each of the above-described Ni—P plating film, Ni—B plating film, Ni—P—B—W plating film, and Ni—P—B plating film is an electroless nickel plating film, and is formed of a known chemical plating method. According to the chemical plating method, the two plating films (i.e., the first and second hard layers 150, 152), each of which has a uniform thickness, can be easily formed on the base body 146 of the shoe 76 by using a simple device.

The first and second hard layers 150, 152 formed on the base body 146 of each shoe 76 effectively prevent seizure due to the sliding contact between the part-spherical surface 132 of the shoe 76 and the recess 128 of the piston 14, the shoe 76 and the piston 14 being formed of similar metallic materials (the aluminum alloy). The first and second hard layers 150, 152 are also effective to prevent seizure between the flat surface 138 of the shoe 76 and the corresponding sliding surface 140, 142 of the swash plate 60. In the present embodiment, the base body 146 of each shoe 76 formed of the material that is principally constituted by aluminum is covered with the first hard layer 150 and the second hard layer 152 which are harder than the base body 146 of the shoe 76. For instance, where the first hard layer 150 is provided by the Ni—P plating film, the first hard layer 150 generally has the Vickers hardness of 400–550. Where the second hard layer 152 is provided by the Ni—P—B—W plating film, the second hard layer 152 generally has the Vickers hardness of 650–800. According to this arrangement, the strength of the shoe 76 is increased, so that the durability of the shoe 76, and accordingly the durability of the swash plate type compressor including the piston 14 can be improved.

The first hard layer 150 (the Ni—P plating film in the present embodiment) provided between the base body 146 of the shoe 76 and the second hard layer 152 (the Ni—P—B—W plating film in the present embodiment) functions as an undercoat layer for increasing adhesion between the base body 146 and the Ni—P—B—W plating film, so as to prevent separation or removal of the Ni—P—B—W plating film from the base body 146. In general, the hardness of the Ni—P—B—W plating film is higher than that of the Ni—P plating film, so that the Ni—P—B—W plating film exhibits an excellent wear resistance. The same advantage is obtained where the second hard layer 152 is formed of a Ni—B plating film. The Ni—P plating film also functions as a cushioning layer or shock-absorbing layer for absorbing the shock applied to the Ni—P—B—W plating film. Accordingly, the present embodiment is effective to prevent chipping and separation or removal of the second hard layer 152 from the base body 146, so that the shoe 76 maintains its slidability and durability for a long time period of service.

The base body 160 of the swash plate 60 is formed of a ferrous material, e.g., a spheroidal graphite cast iron, generally called as ductile cast iron such as FCD 700 or FCD 600 according to the JIS G 5502. On the sliding surfaces 140, 142 which are located at a radially outer portion of the opposite surfaces of the swash plate 60 and on which the pair of shoes 76 slide, there are formed sliding layers 164. In FIG. 2, the thickness of the sliding layer 164 is exaggerated. The sliding layer 164 includes a solid lubricant and at least one thermosetting resin with which particles of the solid lubricant are held together, the solid lubricant containing polytetrafluoroethylene (hereinafter referred to as "PTFE"). For example, the at least one thermosetting resin may be selected from polyamide imide (PAI), phenol resin, epoxy resin, furan resin, urea resin, and unsaturated polyester. It is preferable to employ the thermosetting resin which contains the polyamide imide as a major component. The content of the PTFE in the sliding layer 164 is generally in a range of 10–40 vol. %. The content of the PTFE is preferably not less than 14 vol. %, more preferably not less than 18 vol. %. The solid lubricant preferably contains molybdenum disulfide ($MoS_2$) in addition to the PTFE. The content of the molybdenum disulfide in the sliding layer 164 is generally in a range of 5–30 vol. %. The content of the molybdenum disulfide is preferably not less than 7 vol. %, more preferably not less than 15 vol. %.

In the present embodiment, the swash plate 60 is a first sliding member while the shoe 76 is a second sliding member which slides on the first sliding member in the form of the swash plate 60. In the present embodiment, a sliding device including the first and second sliding members is applied to the swash plate type compressor.

In the present embodiment wherein the sliding layer 164 of the swash plate 60 contains the PTFE in an amount of 10–40 vol. %, the swash plate 60 exhibits excellent sliding characteristics, whereby a resistance to sliding of the swash plate 60 on the shoe 76 is reduced, resulting in high degrees of resistances of the swash plate 60 to seizure and wear. The swash plate type compressor tends to suffer from shortage of the lubricant oil, in an extreme case, a non-lubricating state (so-called "dry" state) wherein the lubricant is not present between the swash plate 60 and each shoe 76 in the compressor, when the compressor is operated after a relatively long period of interruption or when the refrigerant gas leaks from the compressor. The present arrangement assures excellent sliding characteristics of the swash plate 60 even under such severe operating conditions, so that the seizure between the swash plate 60 and the shoe 76 is prevented, effectively avoiding deterioration of the durability of the swash plate 60, and accordingly the compressor.

The Ni—P—B—W plating film of the second hard layer 152 of the shoe 76 may further contain at least one solid lubricant selected from molybdenum disulfide, boron nitride (BN), tungsten disulfide ($WS_2$), graphite, PTFE, for instance. A friction-reducing layer which is a synthetic resin layer that contains the solid lubricant may be formed on at least one portion of the second hard layer 152, which corresponds to at least one of the part-spherical surface 132 and the flat surface 138 of the shoe 76. The solid lubricant used for the friction-reducing layer may be selected from among the above-indicated solid lubricants which are contained in the second hard layer 152, while the synthetic resin may be selected from among polyamide imide, epoxy resin, polyetherketone, phenol resin, for example. These synthetic resins exhibit an excellent heat resistance. Further, owing to the inclusion of the solid lubricant, these synthetic resins have an improved wear resistance and are effective to reduce a coefficient of friction between the shoe 76 and the swash plate 60.

While the presently preferred embodiment of this invention has been described above, for illustrative purpose only, it is to be understood that the present invention is not limited to the details of the illustrated embodiment. In the illustrated embodiment, each shoe 76 is covered with the two plating films in the form of the first and second hard layers 150, 152. The shoe 76 may be covered with a single plating film selected from among those described above with respect to the first and second hard layers 150, 152. While the base body 160 of the swash plate 60 in the illustrated embodiment is formed of the ferrous material, the base body 160 may be formed of an aluminum alloy containing aluminum as a major component, such as A390 defined by the Aluminum Association (AA). Further, the principle of the invention is applicable to a swash plate type compressor equipped with double-headed pistons each having head portions on the opposite sides of the engaging portion, or a swash plate type compressor of fixed capacity type. It is to be understood that the present invention may be embodied with various changes and improvements such as those described in the SUMMARY OF THE INVENTION, which may occur to those skilled in the art.

<Experiments for Examining the Sliding Characteristics of the Swash Plate>

For the swash plate 60 and shoe 76 which constitute the sliding device of the swash plate type compressor described in the DETAILED DESCRIPTION OF THE PREFERRED EMBODIMENT, the following experiments were carried out for examining the sliding characteristics of the swash plate 60 such as the resistances to seizure and wear with respect to the shoe 76. In the following experiments, there were used eleven swash plates 60 (#1–#11) whose sliding layers 164 have respective different contents of the solid lubricant and the thermosetting resin, as indicated in the following TABLE 1. The sliding layers 164 of the respective swash plates #1–#10 produced according to the present invention contain PTFE and molybdenum disulfide ($MoS_2$) as the solid lubricant, and a thermosetting resin which is principally constituted by polyamide imide (PAI), with which particles of the solid lubricant are held together. In the sliding layers 164 of the respective swash plates #1–#10, the content of the PTFE is held in a range of 10–40 vol. % (about 8–50 wt. %), while the content of the molybdenum disulfide is held in a range of 5–30 vol. %. The sliding layer of the swash plate #11 produced as a comparative example does not contain the PTFE as the solid lubricant. Namely, the sliding layer of the comparative swash plate #11 contains the molybdenum disulfide and graphite as the solid lubricant, and a thermosetting resin which is principally constituted by polyamide imide, with which particles of the solid lubricant are held together. The results of the experiments are indicated in TABLE 1.

absence of the lubricant oil, in other words, in a non-lubricating state (i.e., in a dry state), such that the rotating speed of the swash plate was 3,000 rpm and such that the discharge pressure was 0.98 MPa (10 kgf/cm $^2$). There was measured a time elapsed before the seizure took place between the swash plate and the shoes, which swash plate and the shoes slid on each other in the non-lubricating state. Hereinafter, the above-indicated time is referred to as "seizure time".

TABLE 1 also indicates the results of the measurement. As is apparent from the results indicated in TABLE 1, the swash plates #1–#10 whose sliding layers 164 contained the PTFE as the solid lubricant showed longer seizure times in the non-lubricating state than the comparative swash plate #11 whose sliding layer did not contain the PTFE. The swash plates #1–#5, #9, and #10 wherein the content of the PTFE was held in a range of 20 vol. %–40 vol. % (25 wt. %–50 wt. %), in particular, showed the seizure times three or four times as long as that in the comparative swash plate #11.

Experiment (2) for Examining the Seizure Load in the Poor Lubricating State

Figure 3:
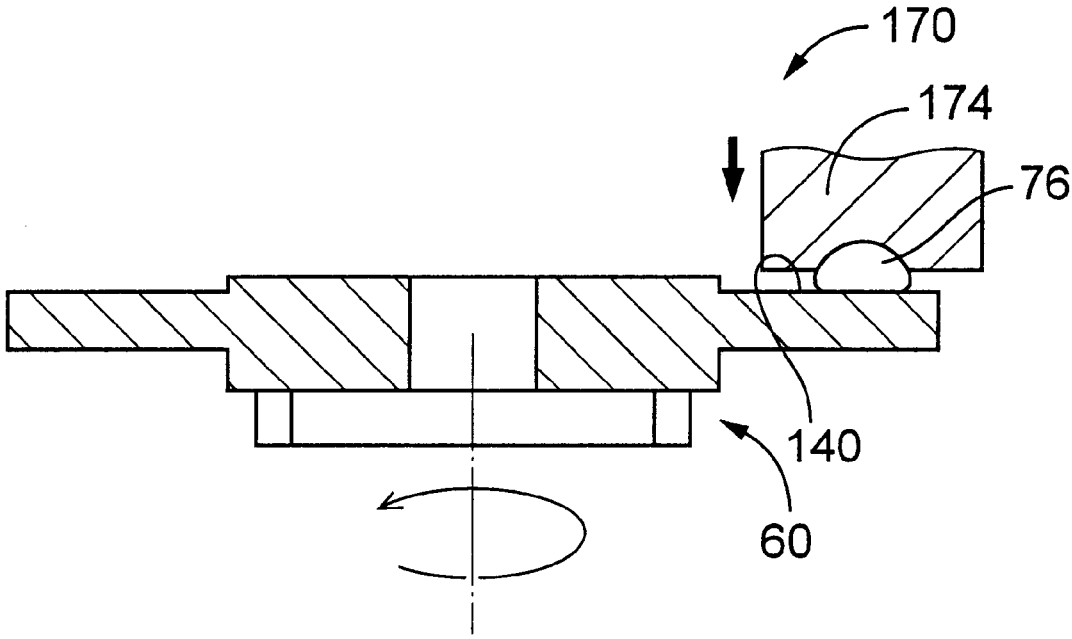
FIG. 3 is a front elevational view in cross section schematically showing a test device used in examining sliding characteristics of the swash plate and the shoe.

In this Experiment (2), the test device 170 shown in FIG. 3 was used. The test device 170 includes a rotary device (not shown) adapted to hold the swash plate 60 and rotate the swash plate 60 about its axis, and a shoe holder 174 adapted

TABLE 1

| | Content (vol. %) | | | | Content (wt. %) | | | | Seizure time in non-lubricating | Seizure load in poor lubricating | Amount of wear |
|---|---|---|---|---|---|---|---|---|---|---|---|
| No. | PAI | PTFE | $MoS_2$ | graphite | PAI | PTFE | $MoS_2$ | graphite | state (seconds) | state (N) | ($\mu$m) |
| # 1 | 50 | 30 | 20 | — | 30.7 | 26.6 | 42.7 | — | 25 | — | 1 |
| # 2 | 60 | 20 | 20 | — | 34.7 | 25.1 | 40.2 | — | 28 | 5880 | 0 |
| # 3 | 50 | 40 | 10 | — | 34.9 | 41.9 | 23.3 | — | 38 | — | 8 |
| # 4 | 60 | 30 | 10 | — | 43.4 | 32.5 | 24.1 | — | 30 | 5488 | 5 |
| # 5 | 70 | 23 | 7 | — | 54.8 | 27.0 | 18.3 | — | 38 | 5096 | 3 |
| # 6 | 70 | 15 | 15 | — | 49.1 | 15.8 | 35.1 | — | 15 | — | — |
| # 7 | 80 | 15 | 5 | — | 67.1 | 18.9 | 14.0 | — | 15 | — | — |
| # 8 | 60 | 10 | 30 | — | 34.3 | 8.6 | 57.1 | — | 12 | — | 0 |
| # 9 | 60 | 40 | 0 | — | 50.0 | 50.0 | 0.0 | — | 40 | — | 20 |
| #10 | 55 | 27 | 18 | — | 34.67 | 25.13 | 40.20 | — | 30 | 6272 | 3 |
| #11 | 50 | 0 | 30 | 20 | 27.5 | 0.0 | 55.0 | 17.6 | 10 | 3136 | — |

For examining the sliding characteristics of the swash plate, the following three kinds of experiments (1)–(3) were carried out, namely, (1) Experiment for examining the seizure resistance in the non-lubricating state, (2) Experiment for examining the seizure load in the poor lubricating state, and (3) Experiment for examining the amount of wear of the swash plate. In the experiments (1) and (3), a variable capacity type swash plate type compressor similar to that explained in the DETAILED DESCRIPTION OF THE PREFERRED EMBODIMENT was used. (A detailed description of the swash type compressor is dispensed with.) In the experiment (2), a test device 170 shown in FIG. 3 was used. The test device 170 will be described. The shoe 76 used in these experiments includes the base body 146 having the Vickers hardness of Hv150 and formed of the aluminum alloy (A 4032), the first hard layer 150 having a thickness of 25 $\mu$m and formed of a Ni—P plating film, and the second hard layer 152 having a thickness of 25 $\mu$m and formed of a Ni—P—B—W plating film. The first and second hard layers 150, 152 are formed on the base body 146 in this order.

Experiment (1) for Examining the Seizure Resistance in the Non-lubricating State In this Experiment (1), each of the swash plates #1–#11 was installed on the compressor in which the lubricant oil was not present. The compressor was operated in the to hold the shoe 76 such that the shoe 76 is held in sliding contact with the sliding surface 140 of the swash plate 60. In this Experiment (2), the swash plate 60 and the shoe 76 slid on each other in a poor-lubricating state wherein the lubricating oil present between the swash plate 60 and the shoe 76 was extremely insufficient. In other words, the lubricating oil was sprayed between the swash plate 60 and the shoe 76 at a rate of 15 mg/min. The shoe 76 held by the shoe holder 174 was pressed against the swash plate 60 held by the rotary device under a load of 392N. The load was increased in increments of 392N every five minute. In this state, the swash plate 60 was rotated at 1,500 rpm. The radius defined by a distance between the axis of the swash plate 60 and a central portion of the contacting surfaces of the swash plate 60 and the shoe 76 was 43 mm, and the speed at which the swash plate 60 and the shoe 76 slide on each other was 68 m/sec. For each of the swash plates #2, #4, #5, and #10 as representative examples according to the present invention, and the comparative swash plate #11, there was measured the load at which the seizure took place (hereinafter referred to as "seizure load") while the swash plate and the shoe slid on each other in the above-described poor lubricating state. The results of measurement are also indicated in TABLE 1.

As is apparent from the results indicated in TABLE 1, the seizure load in the comparative swash plate #11 was 3,136N. In contrast, the seizure load in the swash plate #10 according to the present invention was 6,272N, which value is twice as large as that in the swash plate #11. The seizure load in each of the swash plates #2, #4, and #5 according to the present invention was larger than that in the comparative swash plate #11. According to the present invention, the swash plate 60 and the shoe 76 exhibit a significantly improved seizure resistance even under very severe sliding conditions or heavy load conditions such as the non-lubricating state and the poor lubricating state, so that the swash plate 60 and the shoe 76 maintain excellent sliding characteristics for a long time of service.

Experiment (3) for Examining the Amount of Wear of the Swash Plate

The experiment (3) was carried out by using a refrigerant gas including a lubricating oil which is used during a normal operation of the swash plate type compressor. The swash plate type compressor was alternately and intermittently turned on and off. The compressor was operated such that the rotating speed of the swash plate was 4,500 rpm and such that the discharge pressure was 3.43 MPa (35 kgf/cm $^2$). The compressor was operated under the above-described conditions for twenty-five seconds, and was subsequently kept off for five seconds. This cycle was repeated for twenty hours.

This experiment (3) was conducted on the swash plates #1–#5 and #8–#10 according to the present invention. The results are also shown in TABLE 1. As is apparent from the results indicated in TABLE 1, the amount of wear of the swash plate 60 tends to increase with an increase of the content of the PTFE contained in the sliding layer 164. Accordingly, from the viewpoint of improving both of the wear resistance and the seizure resistance, the content of the PTFE contained in the sliding layer 164 is held preferably in a range of 10 vol. %–40 vol. %, more preferably in a range of 14 vol. %–35 vol. %, and particularly preferably in a range of 18 vol. %–30 vol. %. The swash plate 60 having the thus formed sliding layer 164 exhibits high degrees of wear resistance and seizure resistance, effectively avoiding deterioration of the durability of the swash plate 60 and the shoes 76.

Comparative experiments similar to those described above were conducted on the comparative swash plate #11 under the same conditions described above, wherein the comparative swash plate slid on a shoe formed of high-carbon chrome bearing steel SUJ2 according to JIS G 4805. It was revealed that the comparative swash plate #11 exhibited good sliding characteristics when it slid on the SUJ2 shoe. Described in detail, the seizure time in the non-lubricating state was 25 seconds and the seizure load in the poor lubricating state was 5,880N. When the comparative swash plate #11 slid on the shoe 76 of the present invention in which the base body 146 formed of the aluminum alloy is covered with the first hard layer 150 formed of the Ni—P plating film and the second hard layer 152 formed of the Ni—P—B—W plating film, however, the seizure time in the non-lubricating state was ten seconds and the seizure load in the poor lubricating state was 3,136N, as indicated in TABLE 1. Thus, when the comparative swash plate #11 was used in combination with the above-described nickel-plated shoe 76 of the present invention, the sliding characteristics of the comparative swash plate #11 was deteriorated. It is considered that this phenomenon has some relationship with a fact that the coefficient of friction between the comparative swash plate #11 and the nickel-plated shoe 76 is higher than that between the comparative swash plate #11 and the SUJ2 shoe. It is also considered that this phenomenon has some relationship with a fact that the molybdenum disulfide contained in the sliding layer of the comparative swash plate #11 was transferred onto the flat surface of the SUJ2 shoe under the experiment whereas the molybdenum disulfide was not transferred onto the flat surface of the nickel-plated shoe 76.

What is claimed is:

1. A sliding member comprising at least one sliding layer including a solid lubricant and at least one thermosetting resin with which particles of said solid lubricant are held together, said solid lubricant containing 10–40 vol. % of polytetrafluoroethylene and 5–30 vol. % of molybdenum disulfide.

2. A sliding member according to claim 1, wherein said solid lubricant contains not less than 14 vol. % of said polytetrafluoroethylene.

3. A sliding member according to claim 2, wherein said solid lubricant contains not less than 18 vol. % of said polytetrafluoroethylene.

4. A sliding member according to claim 1, wherein said at least one thermosetting resin contains polyamide imide as a major component.

5. A sliding device comprising:

at least one first sliding member each including at least one sliding layer which includes a solid lubricant and at least one thermosetting resin with which particles of said solid lubricant are held together, said solid lubricant containing 10–40 vol. % of polytetrafluoroethylene; and at least one second sliding member plated with a nickel-based composition; and wherein said at least one first sliding member and said at least one second sliding member slide relative to each other.

6. A sliding device according to claim 5, wherein said at least one second sliding member includes a base body formed of an aluminum alloy and plated with said nickel-based composition.

7. A sliding device according to claim 5, wherein said at least one second sliding member is plated by electroless plating of said nickel-based composition.

8. A sliding device according to claim 5, wherein said at least one second sliding member is plated with at least one nickel-based plating film which is formed of said nickel-based composition and which is selected from a Ni—P film, a Ni—B film, a Ni—P—B—W film, and a Ni—P—B film.

9. A sliding device according to claim 5, wherein said sliding device is used for a compressor.

10. A sliding device according to claim 9, wherein said compressor is of swash plate type, said sliding device comprising a swash plate as said at least one first sliding member and shoes each as said at least one second sliding member for sliding on said swash plate.

11. A sliding device according to claim 5, wherein said at least one first sliding member includes a ferrous base body and said at least one sliding layer formed on said ferrous base body.

* * * * *